United States Patent [19]

Yamazaki

[11] Patent Number: 4,842,430

[45] Date of Patent: Jun. 27, 1989

[54] PRINTING PAPER REVERSING DEVICE

[75] Inventor: Hideo Yamazaki, Tokyo, Japan

[73] Assignee: Ricoh Company, Ltd., Tokyo, Japan

[21] Appl. No.: 216,347

[22] Filed: Jul. 8, 1988

[30] Foreign Application Priority Data

Jul. 11, 1987 [JP] Japan ..... 62-106526[U]

[51] Int. Cl.[4] ..... B41J 29/18

[52] U.S. Cl. ..... 400/708; 400/547; 101/223

[58] Field of Search ..... 400/708, 551, 76, 620, 400/621, 583, 578, 707.1, 708.1; 101/222, 223, 230

[56] References Cited

U.S. PATENT DOCUMENTS

| | | | |
|---|---|---|---|
| 1,114,478 | 10/1914 | Ibarra | 226/184 |
| 3,618,738 | 11/1971 | Boyatt et al. | 400/551 |
| 4,165,191 | 8/1979 | Dickson et al. | 400/708 |
| 4,175,687 | 11/1979 | Kenworthy | 400/551 |
| 4,181,445 | 1/1980 | Haller et al. | 400/708 |
| 4,234,261 | 11/1980 | Hendrischk | 400/621 |
| 4,262,895 | 4/1981 | Wenthe | 271/65 |
| 4,400,963 | 8/1983 | Epps | 226/190 |
| 4,714,364 | 12/1987 | Takada | 400/551 |
| 4,727,437 | 2/1988 | Mizoguchi | 400/708 |

FOREIGN PATENT DOCUMENTS

| | | |
|---|---|---|
| 61-200855 | 12/1986 | Japan . |
| 62-29359 | 2/1987 | Japan . |
| 62-29360 | 2/1987 | Japan . |

*Primary Examiner*—Eugene H. Eickholt

*Attorney, Agent, or Firm*—Oblon, Fisher, Spivak, McClelland & Maier

[57] ABSTRACT

A paper reversing device comprises a paper inlet roller for moving a printing paper toward a guide plate in association with a reversing roller, and a cylindrical fur brush disposed above the guide plate for forcing the printing paper which has passed between the paper inlet roller and the reversing roller toward a paper outlet roller cooperating with the reversing roller, at least one of the paper inlet roller and the reversing roller having a collar at each end thereof for imparting rigidity to the printing paper during the period of time when the printing paper is passing between the paper inlet roller and the reversing roller.

15 Claims, 4 Drawing Sheets

PRINTING PAPER REVERSING DEVICE

BACKGROUND OF THE INVENTION

The present invention relates to printing paper reversing devices used in image forming apparatus such as copying machines, printers, etc.

Conventionally, there are many image forming apparatus such as copying machines or printers which include a printing paper reversing device for arranging the sequence of sheets of copying paper or performing both-side copy or composite copy.

In these reversing devices, printing paper such as copying paper is discharged to a transfer paper reversing table by switching means provided in the feed passageway of the device. By a back-feed roller provided contactable with the reversing table, the original leading end of the printing paper on the transfer paper reversing table is reversed into the new leading end of the printing paper so that the printing paper is fed toward a conveyance passageway.

In such printing paper reversing device, after a sheet of printing paper is completely fed out by the back-feed roller to the conveyance passageway, the next sheet of printing paper must be discharged to the transfer paper reversing table. Furthermore, the back-feed roller is caused to contact the reversing table in a complex manner. Therefore, the reversing capability is limited and the reversing operation is difficult to speed up.

Another printing paper reversing device is proposed which includes a paper inlet roller and a reversing roller which, instead of a back-feed roller, cooperate to discharge a printing paper guided by switching means to a transfer paper reversing table with one of the rollers, for example, the reversing roller, taking the form of a gear wheel, so that the tailing end of the paper is guided toward a paper outlet roller provided in the vicinity of the inlet of the conveyance passageway by causing the teeth of the gear wheel to engage the tailing end of the printing paper. However, in such device, the guide of the printing paper toward the paper outlet roller may not successfully performed depending on the extent of curl in, or the thickness of, the printing paper. Therefore, in such reversing device, a printing paper having a thickness easy to guide or a printing paper difficult to curl is used. In summary, only a limited or somewhat specified paper can be used.

SUMMARY OF THE INVENTION

It is an object of the present invention to provide a paper reversing device which ensures a high speed reversing operation of a printing paper irrespective of types of paper.

It is another object of the present invention to provide a paper reversing device which is capable of reversing a printing paper at high speed and with high reliability.

In order to achieve the above objects, a paper reversing device according to the present invention comprises:

a passageway for feeding a printing paper therealong;

a paper inlet roller disposed in the vicinity of one end of the feeding passageway;

a reversing roller disposed in contacting to the paper inlet roller for guiding the printing paper out of the feeding passageway in association with the paper inlet roller;

a paper outlet roller disposed in contacting to the reversing roller for feeding, in association with the reversing roller, the printing paper having passed between the paper inlet roller and the reversing roller in the direction opposite to the direction in which the paper inlet roller and the reversing roller guide the printing paper;

a guide plate extending from near the position where the paper inlet roller contacts the reversing roller in the direction in which the printing paper having passed between the paper inlet roller and reversing roller moves for receiving the passed printing paper;

means disposed above the guide plate for forcing the printing paper toward the paper outlet roller when the printing paper has passed between the paper inlet roller and reversing roller; and means for driving the paper inlet roller, reversing roller, paper outlet roller and forcinhg means;

wherein at least one of the paper inlet roller and reversing roller has a collar at each end thereof for imparting rigidity to the printing paper during the period of time when the printing paper is passing between the paper inlet roller and reversing roller.

DETAILED DESCRIPTION OF THE PREFERRED EMBODIMENTS

Figure 7:
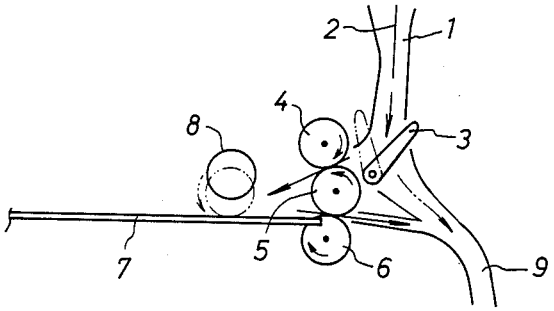
Fig. 7 (PRIOR ART)
FIG. 7 is a rough schematic of a prior art.

First, referring to FIG. 7, a prior art will be described. A printing paper 2 fed to a feed passageway 1 is discharged to a transfer paper reversing table 7 from between a paper inlet roller 4 and a reversing roller 5 by the guide of a switching pawl 3. The original leading and of the printing paper on the transfer paper reversing table 7 is reversed into the new leading end of the printing paper by a back-feed roller 8 provided contactable with the reversing table 7. The printing paper on the transfer paper reversing table 7 is fed by the reversing roller 5 and a paper outlet roller 6 toward a conveyance passageway 9 with the original failing end thereof advanced ahead of the original leading end thereof. When such reversing is not performed, the switching pawl 3 is switched to its broken line position and the printing paper is fed as it is from the feed passageway 1 to a conveyance passageway 9.

In such paper reversing device, after a sheet of printing paper is completely fed out by the back-feed roller 8, the next sheet of printing paper must be discharged toward the reversing table 7. In addition, the back-feed roller 8 is caused to contact a sheet of printing paper in a complex manner each time the same is fed out, so that the reversing capability is limited and the reversing operation difficult to speed up.

Another printing paper reversing device is proposed which instead of the back-feed roller 8 includes a reversing roller 5 in the form of a gear wheel so that the tailing end of a printing paper is guided toward a paper outlet roller 6 by causing the teeth of the gear wheel to engage the tailing end of the printing paper. However, in such device, the guide of the printing paper toward the paper outlet roller may not successfully performed depending on the extent of curl in, or the thickness of, the printing paper. Therefore, in such reversing device, a printing paper having a thickness easy to guide or a printing paper difficult to curl is used. In summary, only a limited or somewhat specified sheet of paper can be used.

Figure 1:
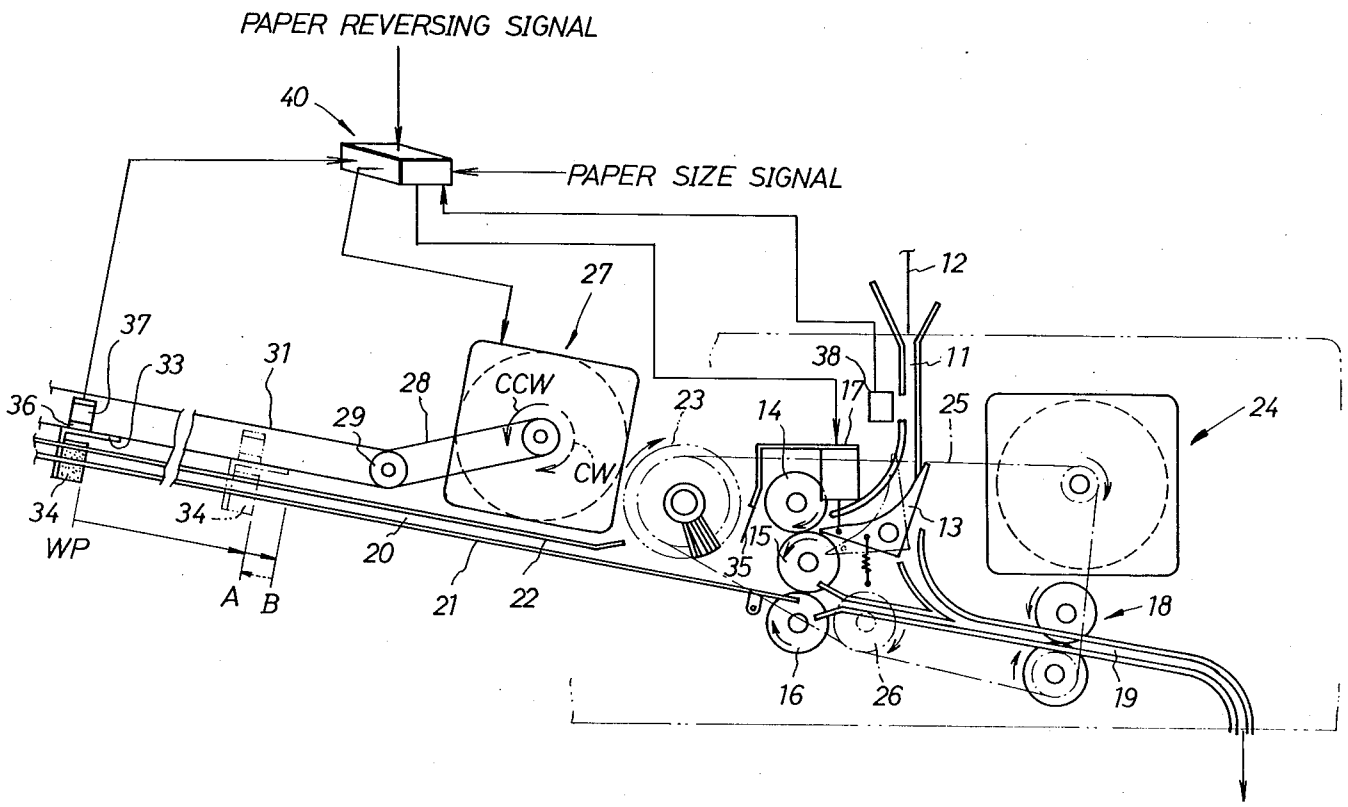
FIG. 1 is a schematic of a preferred embodiment of the present invention.

The present invention will now be described with respect to a preferred embodiment thereof. FIG. 1 illustrates a paper reversing device of the embodiment. When a printing paper is not to be reversed, a solenoid 17 is not energized with a switching pawl 13 being positioned at a position shown by the phantom line. A sheet of printing paper 12 fed to a feed passageway 11 is guided by the switching pawl and discharged by a pair of discharge rollers 18 along a conveyance passageway 19.

When a printing paper is to be reversed, a paper reversing signal is input to a control unit 40 of the reversing device. This causes the solenoid 17 to be energized to rotate the switching pawl 13 to the solid line position. Thus, the printing paper 12 fed to the feed passageway 11 is guided by the switching pawl 13 and bitten by a paper inlet roller 14 and a reversing roller 15 constituting a pair with the paper inlet roller 14 and fed to a paper reversing passageway 20 formed between guide plates 21 and 22.

The reversing roller 15, a lower one of the discharge rollers 18, and a cylindrical fur brush 23 which will be desvcribed in more detail later are driven by a drive motor 24 in their respective directions of arrow through a timing belt 25. When a gear pulley 26 is driven in the direction of the arrow, the reversing roller 15 is driven by means of a further gear wheel (not shown) on the shaft of the gear pulley 26 and a still further gear wheel (not shown) on the shaft of the reversing roller 15 meshing with the former further gear wheel.

Figure 5:
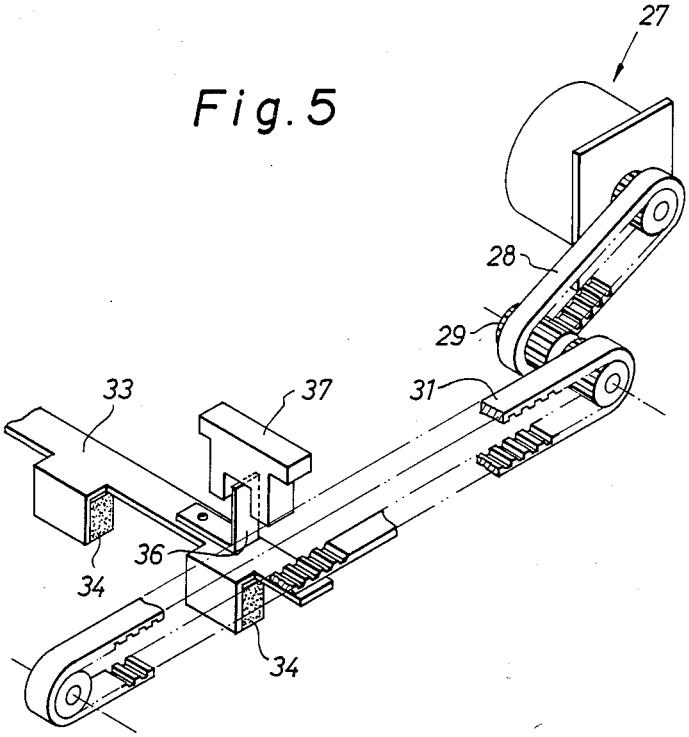
FIG. 5 is a perspective view of one example of a size stop mechanism.

A timing belt 31 is provided above the guide plate 22, a mounting plate 33 is fixed to a part of the timing belt 31 which extends in a region closer to the guide plate 22, as shown in FIG. 5, and a stop member 34 of an elastic foamed material such as sponge is bonded to the plate 33. Hereinafter, such stop member is also called a size stop. Size stop 34 is driven by a size stop drive motor 27 via drive transmitting means comprising the timing belt 28, gear pulley 29 and timing belt 31 in the direction in which the timing belt 31 extends.

In FIG. 1, as described above, when a printing paper is reversed, it is fed to a paper reversing passageway 20 by the paper inlet roller 14 and reversing roller 15.

In such paper reversing mode, when the paper reversing input signal and a paper size signal indicative of the size of a printing paper used are input to the control unit 40 of the device, the size stop drive motor 27 is rotated counterclockwise. This causes the size stop 34 to move from its waiting position WP in the direction of the arrow via the timing belts 28 and 31 and to stop at a predetermined paper size position shown by A.

As shown in FIG. 5, the mounting plate 33 has a shield plate 36 fixed thereto, which is inserted into a waiting position sensor 37 when the size stop 34 is at its waiting position.

The size stop 34 is so adapted as to start to move from its waiting position and to stop at its predetermined paper size position A.

The size stop 34 is positioned into the predetermined paper size position A when the motor 27 rotates by an angle corresponding to a predetermined number of pulses after the shield plate 36 shown in FIG. 5 leaves the sensor 37. Therefore, it is advantageous to use a step motor as such motor.

The predetermined size position varies depending on the paper size and is such that the distance between the point of contact of roller 14 with roller 15 and the size stop 34 at the position A (shown by the broken line) is slightly larger than the length of a printing paper used.

The size stop 34 at the broken line position has a function of stopping a printing paper at its leading end in order to prevent the printing paper from excessively conveyed in the paper reversing passageway 20 and from getting out of bitten at the tailing end of the printing paper by the rollers 15 and 16.

Figure 2:
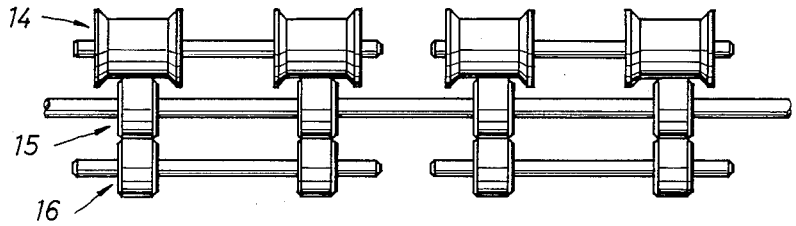
FIG. 2 illustrates a combination of a paper inlet roller and a reversing roller.

As shown in FIG. 2, the paper inlet roller 14 has a collar at each end thereof. When a printing paper passes between the rollers 14 and 15, it becomes corrugated perpendicular to the direction of movement of the printing paper to thereby result in increased rigidity. While in the present embodiment the paper inlet roller 14 is constituted as a collared roller to provide rigidity to the printing paper, the reversing roller 15 may have a collar instead to thereby form a corrugation on the printing paper. Alternatively, both of the rollers 14 and 15 may have a collar in order to form a corrugation on the printing paper.

Figure 3:
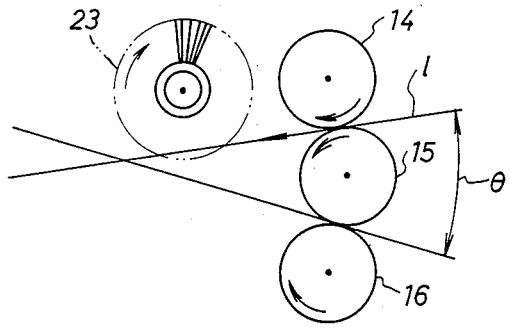
FIG. 3 illustrates the positional relationship between the paper inlet roller and a cylindrical fur brush.

The fur brush 23 is disposed as shown in FIG. 3 such that part of the brush 23, namely, the brush bristles, extend through a tangent l to the rollers 14 and 15 toward the guide plate 21. The tangent l also denotes the direction in which the printing paper passing between the rollers 14 and 15 moves.

When the printing paper passes between the rollers 14 and 15, it becomes corrugated and then hit on the periphery of the fur brush 23 to thereby deform elastically the peripheral portion of the fur brush compulsively inwardly against the elasticity of the fur brush.

Figure 4:
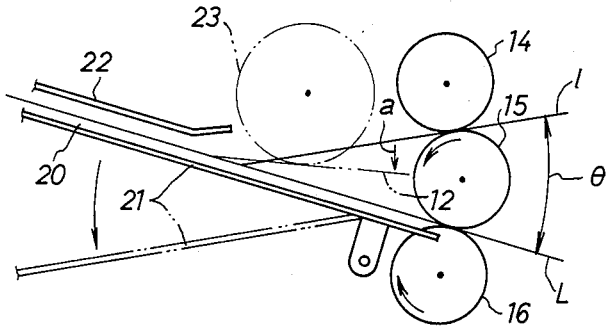
FIG. 4 illustrates the positional relationship among the paper inlet roller, cylindrical fur brush and guide plate.

When the tailing end of the printing paper has passed between the rollers 14 and 15 while being subjected to such deformation, no more rigidity is imparted to the printing paper. Namely, the printing paper is released from impartation of rigidity at which time the elastically deformed surface portion of the fur brush is expanded elastically. At that time, by the elastic restoring force, the printing paper 12 is forced in the direction of the arrow as shown in FIG. 4, whereby the tailing end of the paper is brought close to the paper outlet roller 16.

A predetermined preset time T after the printing paper is moved by the rollers 14 and 15 toward the paper reversing passageway 20, and the tailing end of the paper passes, namely, is sensed by, a reflective sensor 38, a motor 27 which has been at rest so far starts to rotate counterclockwise through a predetermined angle. The preset time T is determined by the distance between the sensor 38 and the point of contact of the roller 14 with the roller 15, and by the conveyance speed of the printing paper. The motor 27 starts to rotate counterclockwise substantially when the tailing end of the printing paper has passed the point of contact of the roller 14 with the roller 15.

This causes the size stop 34 at the position A in FIG. 1 to slightly move toward the paper output roller 16, which then causes the stop 34 to force the printing paper in the reversing passageway such that the tailing end of the printing paper forced toward the paper outlet roller 16 is reliably bitten between the rollers 16 and 15. Now, the printing paper is fed in the conveyance passageway 19 with its original taining end advanced ahead of its original leading end. In this manner, the printing paper is reversed.

In FIG. 1, the position B at which the size stop 34 moving from the position A stops is also a position where the tailing end of the printing paper is bitten by the rollers 15 and 16.

While the position A has been defined above, it is also a position where the leading end of the printing paper is restricted such that the tailing end of the printing paper having moved toward the paper outlet roller 16 is placed near the roller 16. This serves to reduce a quantity of movement of the printing paper forced by the stop 34 and ensure that the tailing end of the printing paper is reliably bitten between the roller 15 and 16.

After the printing paper is forced, the motor 27 is now rotated clockwise. When the size stop returns from its position B to its position A, the motor 27 stops in preparation for the reverse of the next sheet of printing paper. A predetermined time after all sheets of printing paper have completed their reverse by repetition of such operations, for example, when copy ends in a copy machine, the motor 27 rotates clockwise. This causes the size stop 34 to move toward its waiting position. When the shield plate 36 shown in FIG. 5 interrupts the sensing path of the sensor 37, the motor 27 stops and the size stop 34 stops at its waiting position.

The size stop drive motor 27, and timing belts 28, 31 constitute a size stop drive means which moves the size stop 34 from its waiting position to the predetermined paper size position A, and then moves the size stop 34 from the position A to a position where the tailing end of the printing paper is bitten between the rollers 15 and 16 when the tailing end of the printing paper has passed between rollers 14 and 15 toward the paper outlet roller 16, and thereafter returns the size stop to the predetermined paper size position.

Figure 6:
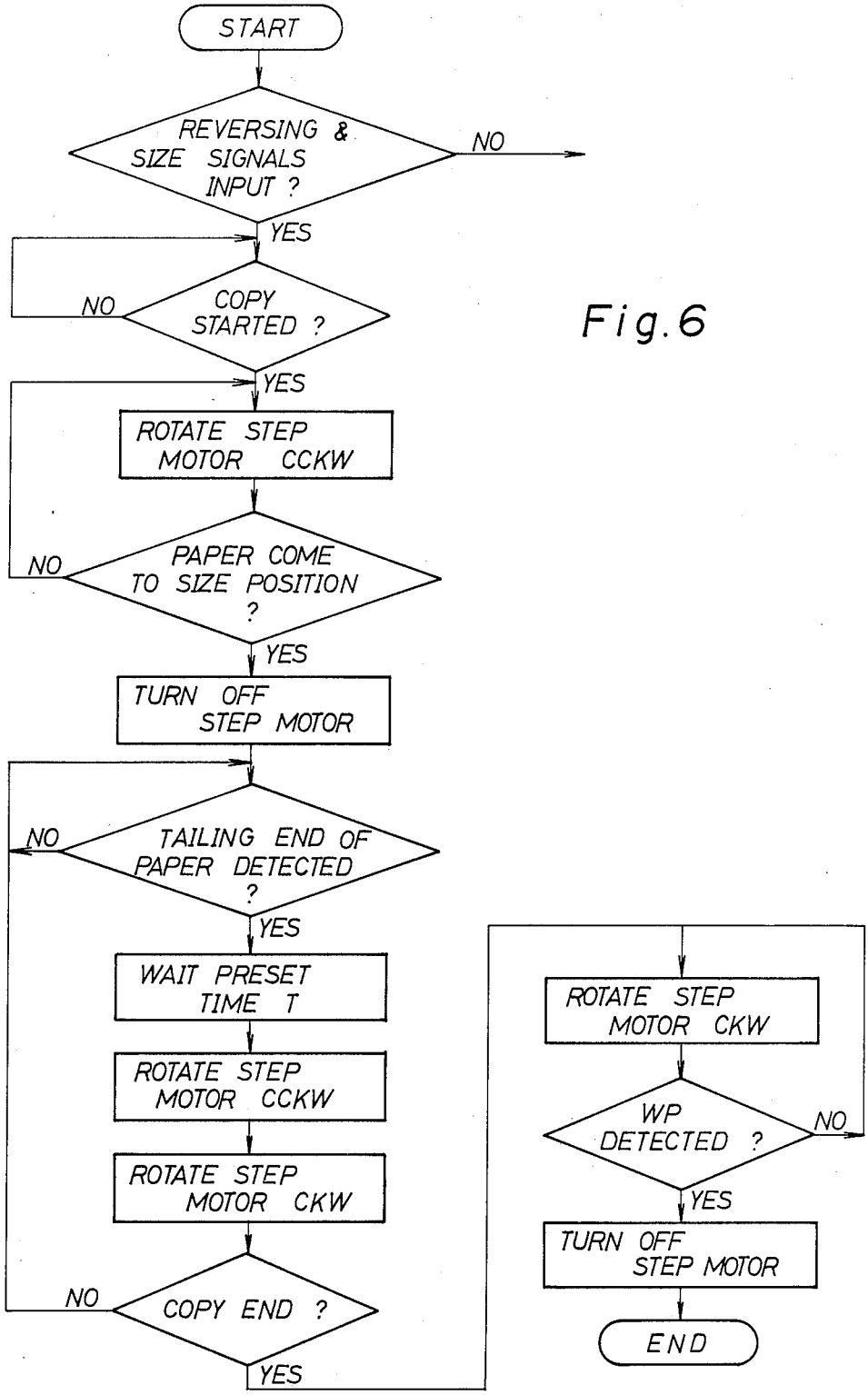
FIG. 6 is a control flowchart corresponding to the operation of the preferred embodiment.

FIG. 6 is a flowchart outlining the operation of the embodiment excluding the non-reverse of a printing paper in which neither a reversing signal nor a size signal is input. The step motor shown is taken as an example of the size stop drive motor 27 in FIG. 1.

In FIG. 4, a printing paper in the paper reversing passageway 20 is conveyed along a line L extending through the point of contact of the roller 15 with the roller 16 and parallel to the guide plate 21. The angle $\theta$ between the lines L and l is an angle at which the printing paper enters the paper reversing passageway 20.

While the angle $\theta$ varies depending on the specification of a printing paper and the conditions of paper conveyance, it is advantageously set within a range, for example, of 10°–40°. For example, if the angle $\theta$ is set to a value less than 10°, the tailing of the printing paper is not effectively forced toward the paper outlet roller 16 whereas if the angle $\theta$ is set to a value more than 40°, the printing paper has an increased tendency to be bent when it enters the paper reversing passageway 20, thereby causing jamming. If jamming should occur, the guide plate 21 should be rotated toward the position shown by the phantom line to remove the printing paper.

The cylindrical fur brush 23 is disposed above a printing paper passing between the guide plates 21 and 22 such that no load is imposed on the printing paper when it is reversed. If a sheet of relatively soft paper or a printing paper difficult to curl can be used, an appropriate elastic member such as an electric charge eliminating brush 35 (shown in FIG. 1) may be used instead of the elastic member comprising the fur brush 23. In FIG. 1, the paper passageway extending from the paper reversing passageway 20 to the discharge roller pair 18 is substantially linear such that no load is imposed on the printing paper discharged from between the rollers 15 and 16.

As described above, in the present embodiment, once the tailing end of a printing paper is bitten between the rollers 15 and 16, the next sheet of printing paper can be fed into the paper reversing passageway 20 to thereby accomplish high speed reverse processing. Since the printing paper is forced by the size stop 34, the tailing end of the printing paper is reliably bitten between the rollers 15 and 16 to thereby be reversed with high reliability. While the device of FIG. 1 is shown as being arranged substantially horizontally, it may be used in a substantially vertically disposed manner.

According to the present invention, a printing paper can be reversed reliably irrespective of the thickness and quality of the printing paper and the extent of curl of the printing paper, and the processing of a printing paper can be performed at high speed and with high reliability.

What is claimed is:

1. A paper reversing device comprising:

a passageway for feeding a printing paper therealong;

a paper inlet roller disposed in the vicinity of one end of the feeding passageway;

a reversing roller disposed in contacting to the paper inlet roller for guiding the printing paper out of the feeding passageway in association with the paper inlet roller;

a paper outlet roller disposed in contacting to the reversing roller for feeding, in association with the reversing roller, the printing paper having passed between the paper inlet roller and the reversing roller in the direction opposite to the direction in which the paper inlet roller and the reversing roller guide the printing paper;

a first guide plate extending from near the position where the paper inlet roller contacts the reversing roller in the direction in which the printing paper having passed between the paper inlet roller and reversing roller moves for receiving the passed printing paper;

means disposed above the first guide plate for forcing the printing paper toward the paper outlet roller when the printing paper has passed between the paper inlet roller and reversing roller; and means for driving the paper inlet roller, reversing roller, paper outlet roller and forcing means;

wherein at least one of the paper inlet roller and reversing roller has a collar at each end thereof for imparting rigidity to the printing paper during the period of time when the printing paper is passing between the paper inlet roller and reversing roller.

2. A paper reversing device according to claim 1, wherein the paper inlet roller has a collar at each end thereof.

3. A paper reversing device according to claim 1, wherein the reversing roller has a collar at each end thereof.

4. A paper reversing device according to claim 1, wherein the paper inlet roller and reversing roller each have a collar at each end thereof.

5. A paper reversing device according to claim 1, wherein the forcing means includes a cylindrical fur brush.

6. A paper reversing device according to claim 5, wherein the driving means includes a motor, a gear pulley cooperating with the reversing roller, and a timing belt extending around a shaft of the motor, and shafts of the gear pulley and the cylindrical fur brush.

7. A paper reversing device according to claim 1, wherein the paper outlet roller and the first guide plate are disposed relative to the reversing roller such that the angle between a tangent which is common to the paper inlet roller and reversing roller and passes through a point where the paper inlet roller contacts the reversing roller and a straight line which passes through a point where the reversing roller contacts the paper outlet roller and is parallel to the first guide plate is within a range of 10° to 40°.

8. A paper reversing device according to claim 5, wherein the forcing means is disposed at a position where the bristles of the fur brush extend toward the first guide plate beyond the common tangent to the paper inlet roller and reversing roller.

9. A paper reversing device according to claim 1, further comprising:

a second guide plate disposed above the first guide plate for forming, in association with the first guide plate, a reversing passageway along which the passed printing paper is returned in the direction opposite to the direction in which the passed printing paper moves;

a stop movably disposed in the reversing passageway for stopping the printing paper, at its leading end, fed into the reversing passageway by the paper inlet roller and reversing roller; and stop drive means for moving the stop from its waiting position to a predetermined paper size position, and further moving the stop from the predetermined paper size position to a position where a tailing end of the printing paper is bitten between the reversing roller and paper outlet roller when the tailing end of the printing paper has passed between the paper inlet roller and reversing roller and has been displaced toward the paper outlet roller, and thereafter returning the stop to the predetermined paper size position;

the predetermined paper size position being a position where a leading end of the printing paper is restricted such that the tailing end of the printing paper having been displaced toward the paper outlet roller is positioned in the vicinity of the paper outlet roller.

10. A paper reversing device comprising:

a passageway for feeding a printing paper therealong;

a paper inlet roller disposed in the vicinity of one end of the feeding passageway;

a reversing roller disposed in contacting to the paper inlet roller for guiding the printing paper out of the feeding passageway in association with the paper inlet roller;

a paper outlet roller disposed in contacting to the reversing roller for feeding, in association with the reversing roller, the printing paper having passed between the paper inlet roller and the reversing roller in the direction opposite to the direction in which the paper inlet roller and the reversing roller guide the printing paper;

means for driving the paper inlet roller, reversing roller and paper outlet roller;

a first guide plate extending from near the position where the paper inlet roller contacts the reversing roller in the direction in which the printing paper having passed between the paper inlet roller and reversing roller moves for receiving the passed printing paper;

a second guide plate disposed above the first guide plate for forming, in association with the first guide plate, a reversing passageway along which the passed printing paper is returned in the direction opposite to the direction in which the passed printing paper moves;

a stop movably disposed in the reversing passageway for stopping the printing paper, at its leading end, fed into the reversing passageway by the paper inlet roller and reversing roller; and stop drive means for moving the stop from its waiting position to a predetermined paper size position, and further moving the stop from the predetermined paper size portion to a position where a tailing end of the printing paper is bitten between the reversing roller and paper outlet roller when the tailing end of the printing paper has passed between the paper inlet roller and reversing roller to thereby be displaced toward the paper outlet roller, and thereafter returning the stop to the predetermined paper size position;

the predetermined paper size position being a position where a leading end of the printing paper is restricted such that the tailing end of the printing paper having been displaced toward the paper outlet roller is positioned in the vicinity of the paper outlet roller.

11. A paper reversing device according to claim 10, wherein the driving means includes a first motor, a first gear pulley cooperating with the reversing roller, and a first timing belt extending around the first motor, and the first gear pulley.

12. A paper reversing device according to claim 10, wherein the paper outlet roller and the first guide plate are disposed relative to the reversing roller such that the angle between a tangent which is common to the paper inlet roller and the reversing roller and passes through a point where the paper inlet roller contacts the reversing roller and a straight line which passes through a point where the reversing roller contacts the paper outlet roller and is parallel to the first guide plate is within a range of 10° to 40°.

13. A paper reversing device according to claim 10, wherein the stop drive means comprises a second motor, a second gear pulley cooperating with the second motor, a second timing belt extending around the shaft of the second motor and the seciond gear pulley, a third gear pulley cooperating with the second gear pulley, and a third timing belt extending around the second and third gear pulleys.

14. A paper reversing device according to claim 13, wherein the stop comprises an elastic foamed member attached to a mounting member fixed to a part of the third timing belt which extends in a region closer to the second guide plate.

15. A paper reversing device according to claim 13, wherein the stop drive means comprises control means for controlling the second motor so as to move the stop from its waiting position to the predetermined paper size position, and further moving the stop from the predetermined paper size position to a position where the tailing end of the printing paper is bitten between the reversing roller and paper outlet roller when the tailing end of the printing paper has passed between the paper inlet roller and reversing roller and has been displaced toward the paper outlet roller, and thereafter returning the stop to the predetermined paper size position.

* * * * *